US007850030B2

(12) United States Patent
Lin

(10) Patent No.: US 7,850,030 B2
(45) Date of Patent: Dec. 14, 2010

(54) EXPANSIBLE BOTTLE STOPPER WITH RADIAL EXPANSION AND SHRINKAGE

(75) Inventor: Sen-I Lin, Yong Kang (TW)

(73) Assignee: Sunlot Bottle Stopper Co., Ltd., Yong Kang (TW)

( * ) Notice: Subject to any disclaimer, the term of this patent is extended or adjusted under 35 U.S.C. 154(b) by 717 days.

(21) Appl. No.: 11/842,303

(22) Filed: Aug. 21, 2007

(65) Prior Publication Data

US 2008/0116165 A1 May 22, 2008

(30) Foreign Application Priority Data

Nov. 16, 2006 (TW) ..... 95142449 A

(51) Int. Cl.

| | |
|---|---|
| ***B65D 39/00*** | (2006.01) |
| ***B65D 23/00*** | (2006.01) |
| ***B65D 53/00*** | (2006.01) |
| *F16L 55/10* | (2006.01) |

(52) U.S. Cl. ..... 215/361; 215/294; 215/296; 215/364; 220/234; 220/238; 138/89

(58) Field of Classification Search ..... 220/233, 220/234, 235–238; 215/364, 358, 361, 359, 215/294, 296; 217/108, 110; 138/89
See application file for complete search history.

(56) References Cited

U.S. PATENT DOCUMENTS

| | | | | |
|---|---|---|---|---|
| 6,536,618 | B1 * | 3/2003 | Hwang et al. | 215/358 |
| 6,719,160 | B2 * | 4/2004 | Sen-Yih | 215/361 |
| 6,915,920 | B2 * | 7/2005 | Hwang et al. | 215/358 |

OTHER PUBLICATIONS

Taiwan Patent Publication No. 467850 (11pp.).
Taiwan Utility Model No. 327412 (5pp.).
Taiwan Utility Model No. 409703 (5pp.).

* cited by examiner

*Primary Examiner*—Robin Hylton
(74) *Attorney, Agent, or Firm*—Alan Kamrath; Kamrath & Associates PA

(57) ABSTRACT

An expansible bottle stopper includes a body, a resilient member, and a movable member that is longitudinally movable relative to the body. The resilient member is caused to expand radially by a first-stage longitudinal displacement of the movable member relative to the body or to shrink radially by a second-stage longitudinal displacement of the movable member relative to the body.

14 Claims, 5 Drawing Sheets

EXPANSIBLE BOTTLE STOPPER WITH RADIAL EXPANSION AND SHRINKAGE

BACKGROUND OF THE INVENTION

1. Field of the Invention

The present invention relates to a bottle stopper and, more particularly, to a bottle stopper for a liquid container, which is expansible in a radial direction for sealing the liquid container and shrinkable in said direction for opening.

2. Description of Related Art

Liquids such as vinegar, oil, whiskey, wine, etc. are packaged in containers such as bottles or urns made of glass or potter clay. During packaging, a liquid is injected into the container, and a stopper is inserted into the mouth of the container to seal the container. The outer diameter of the stopper is slightly larger than the inner diameter of the mouth of the container to assure sealing between the inner wall of the mouth of the container and the outer periphery of the stopper mounted in the mouth. Therefore, the stopper is able to resist high pressure inside the container and, thereby, preserves the liquid in the container.

Traditional methods for sealing the mouth of a container include use of metal caps with inner threading, corks for wines, and stoppers made of a compressible material such as rubber. Metal caps cannot provide a satisfactory sealing effect for long-term preservation and require expensive sealing machines for mass production. Corks submerged in wine are liable to break, generating cork scraps in wine. Furthermore, corks are not suitable for white alcohols and liquids other than wines.

Taiwan Patent Publication No. 467850 discloses a bottle stopper including a pressing member that is pressed axially downward to force an expansible portion of a body to expand radially outward when using the bottle stopper to seal a bottle. The expansible portion of the body causes radial expansion of a peripheral wall of a resilient member to tightly press against and seal the bottle. The resilient member is made of elastomeric material to replace corks that are liable to break when opening the bottle. However, although the peripheral wall of the resilient member can radially expand by downward movement of a shank of the pressing member and the expansible portion of the body, the bottle stopper has too many elements to cut the costs thereof. Furthermore, the extent of radial expansion of the bottle stopper is limited, which is particularly true for bottles made by blowing glass materials. Further, bottles made by blowing have small protrusions or recesses in the inner wall of the neck such that precise control of the inner diameter of the neck is impossible while leakage problems arise. Further, the body of the bottle stopper includes only four petals such that the resilient member has substantially square cross sections when the petals expand radially, failing to provide efficient sealing to the inner wall of the mouth of the bottle.

Another type of conventional bottle stopper disclosed in TW Utility Model No. 327412includes a pin, and around which a resilient member, a block, a washer, and a cap are stacked in sequence. A lever is pivotally mounted to an outer face of the cap. When the lever is bent downward, a bottom of the pin is moved upward to press against and cause radial expansion of the resilient member. Thus, the length of the resilient member is compressed to produce larger radial expansion to thereby enhance sealing reliability. However, currently available automatic bottle-sealing machines cannot proceed with pivotal movement for moving the lever but perform axial downward movement. Further, the lever on the cap prevents the cap from combining with various ornamental caps for different bottles.

An adjustable type of conventional bottle stopper disclosed in TW Utility Model No. 409703 includes a knob, a resilient member, and an adjusting rod. A threaded groove is defined in a bottom of the knob, whereas the adjusting rod includes outer threading on a top thereof. After the bottle stopper is mounted in a mouth of a bottle, the adjusting rod is moved upward when the knob is turned, causing the bottom of the adjusting rod to press against and cause radial expansion of the resilient member. Thus, the length of the resilient member is compressed to produce larger radial expansion to thereby enhance sealing reliability. However, currently available automatic bottle-sealing machines can only proceed with axial downward movement. Further, free rotation of the knob occurs easily, for the bottom of the adjusting rod does not reliably press against the inner wall of the neck of the bottle, failing to achieve the expected sealing effect. Further, the bottle stopper has no means for retaining it in an appropriate threaded locking state.

The above-mentioned conventional bottle stoppers have various disadvantages and have more elements that lead to high costs. Further improvement is, thus, required.

OBJECTS OF THE INVENTION

The primary object of the present invention is to provide an expansible bottle stopper including a body, a resilient member, and a movable member that is longitudinally movable relative to the body. By a first-stage longitudinal displacement of the movable member relative to the body, the resilient member is caused to expand radially to tightly attach to an inner wall of a mouth of a container. Long-term preservation of liquid in the container can be attained without the risk of quality degrading.

The secondary object of the present invention is to provide an expansible bottle stopper including a body, a resilient member, and a movable member that is longitudinally movable relative to the body. By a second-stage longitudinal displacement of the movable member relative to the body, the resilient member is caused to shrink radially. As a result, the bottle stopper can be easily removed from the mouth of the container for pouring out the liquid preserved in the container or can still loosely seal the container.

A further object of the present invention is to provide an expansible bottle stopper including a body, a resilient member, and a movable member that is longitudinally movable relative to the body. By a second-stage longitudinal displacement of the movable member relative to the body, the resilient member is caused to shrink radially to allow the bottle stopper to be easily removed from the mouth of the container, thereby allowing liquid in the container to be poured out. Furthermore, the appearance of the bottle stopper is perceptibly destructed to prevent the bottle from being reinserted into the mouth of the container, thereby attaining an anti-forgery effect.

Still another object of the present invention is to provide an expansible bottle stopper including a body, a resilient member, and a movable member that is longitudinally movable relative to the body. The resilient member and the body are integrally formed to avoid disengagement of one from the other.

SUMMARY OF THE INVENTION

An expansible bottle stopper according to the preferred teachings of the present invention includes a body, a resilient member, and a movable member that is longitudinally movable relative to the body. By a first-stage longitudinal displacement of the movable member relative to the body, the resilient member is caused to expand radially to tightly attach to an inner wall of a mouth of a container. By a second-stage longitudinal displacement of the movable member relative to the body, the resilient member is caused to shrink radially to allow the bottle stopper to be easily removed from the mouth of the container, thereby allowing liquid in the container to be poured out.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
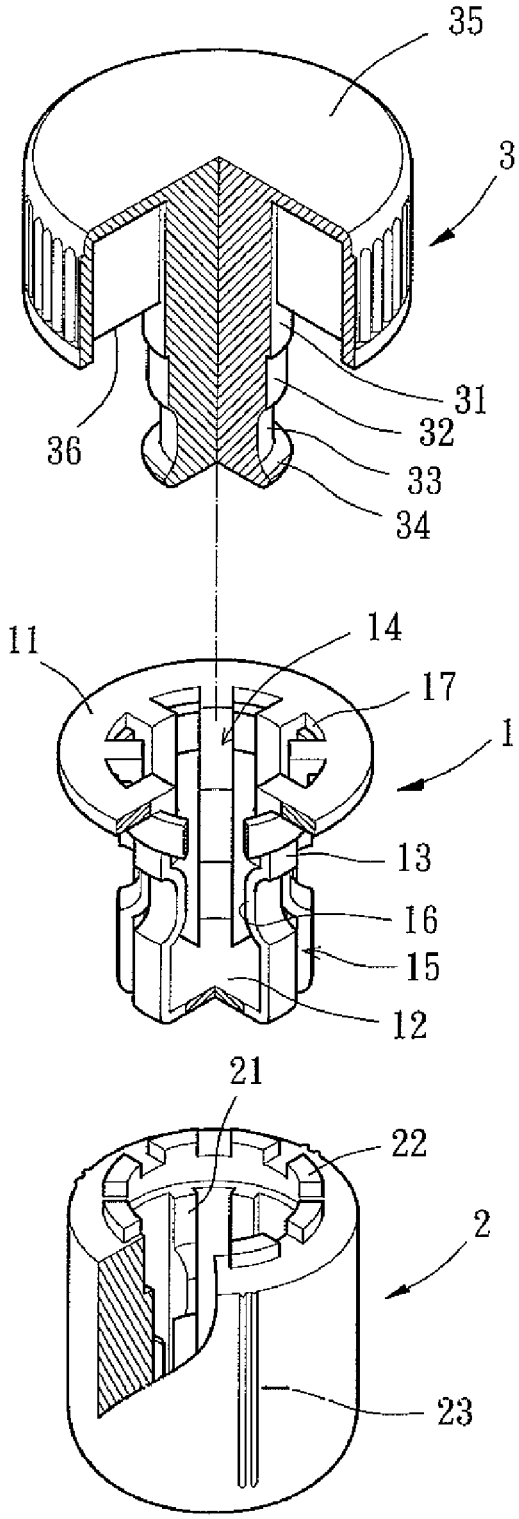
FIG. 1 is an exploded perspective view of an expansible bottle stopper of a first embodiment according to the present invention.

Referring to FIG. 1, an expansible bottle stopper of a first embodiment according to the present invention includes a body 1, a resilient member 2, and a movable member 3 that can be assembled together to form a bottle stopper or the like for sealing a container such as a glass bottle, potter bottle, china bottle, urn, metal bottle, etc.

Still referring to FIG. 1, the body 1 may be formed by injection molding of inert material such as plastics The body 1 includes a top disc 11 having a circular hole 14 defined therethrough. A plurality of annularly spaced connecting plates 13 axially extend from and is connected to the top disc 11. In this embodiment, there are eight connecting plates 13, with a gap 15 formed between a pair of connecting plates 13. Each connecting plate 13 includes an abutting portion 16 extending radially inward In this embodiment, each abutting portion 16 and the plurality of annularly spaced connecting plates 13 further define the circular hole 14. Distal ends of the connecting plates 13 are connected together by a bottom disc 12 to provide improved strength for the connecting plates 13.

The resilient member 2 may be made of rubber or combined rubber/plastic materials by foaming to form an elastomer with appropriate compressibility. In this embodiment, the resilient member 2 is cylindrical and engaged with outer sides of the connecting plates 13 of the body 1. Alternatively, the resilient member 2 and the body 1 are integrally formed, with ribs 21 on the resilient member 2 fitted in the gaps 15 of the body 1, and with protrusions 22 on top of the resilient member 2 engaged in preserved slots 17 in the top disc 11. Thus, the resilient member 2 and the body 1 can be firmly engaged together without the risk of disengagement. The resilient member 2 includes a plurality of air guiding channels 23 on an outer periphery thereof, allowing gas in a container to be exhausted when the resilient member 2 is mounted in a mouth of the container.

The movable member 3 may be made by injection molding of inert material such as plastics. The movable member 3 includes a head 35 of a larger area and a shank 31 extending from a side of the head 35. The head 35 may be in the form of a cap. Alternatively, the head 35 can be coupled with a cap made of metal, ceramic, china, wood, or glass materials. The shank 31 can be inserted into the circular hole 14 of the body 1. The shank 31 includes an abutting portion 32 that abuts against the abutting portion 16 of the body 1 such that the connecting plates 13 of the body 1 can push the resilient member 2 to expand radially. The shank 31 further includes a reduced coupling portion 33. When the shank 31 of the movable member 3 moves axially relative to the body 1, the coupling portion 33 engages with the abutting portion 16 to cause radial shrinkage of the resilient member 2. The head 35 includes a stop 36 that abuts against and is stopped by the top disc 11 of the body 1 to stop the shank 31 of the movable member 3 that has axially moved in the body 1 through a predetermined distance. Displacement of the shank 31 can, thus, be fixed. The shank 31 includes a disengagement preventing portion 34 below the coupling portion 33 so that the movable member 3 will not disengage from the body 1. The disengagement preventing effect of the movable member 3 is better when the diameter of the disengagement preventing portion 34 is larger than that of the abutting portion 32.

Figure 2:
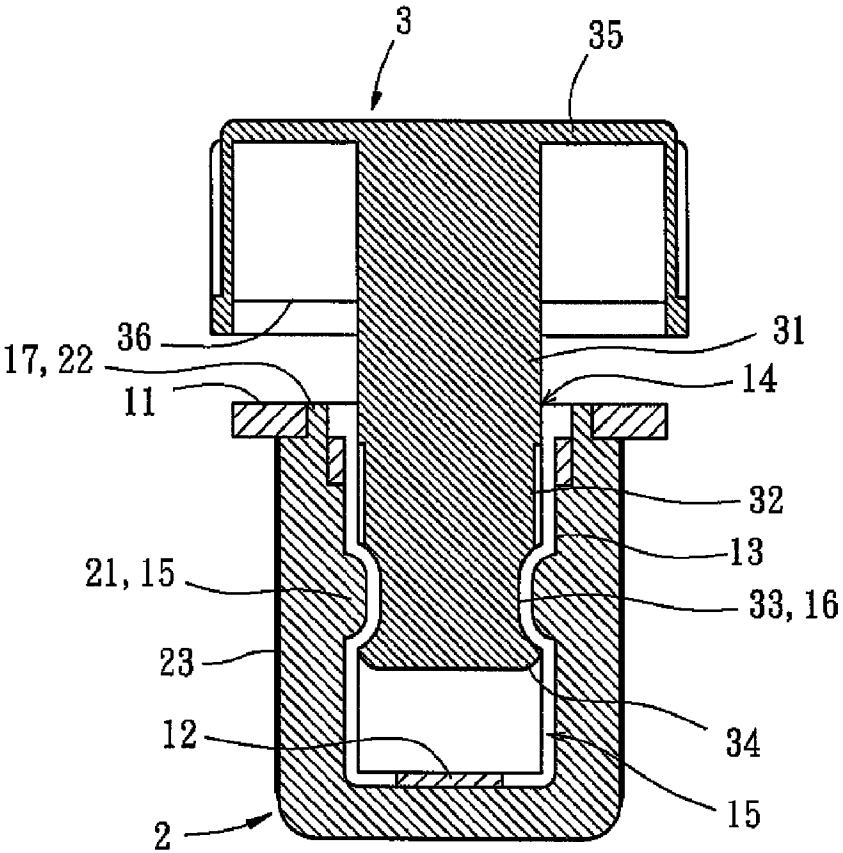
FIG. 2 is a sectional view of the expansible bottle stopper of the first embodiment according to the present invention after assembly.

FIG. 2 shows the bottle stopper of the first embodiment after assembly. The coupling portion 33 of the movable member 3 is engaged with the abutting portion 16 of the connecting plates 13 of the body 1. Thus, the diameter of the resilient member 2 has not be expanded yet (i.e., the resilient member 2 is in a smaller diameter state). In this state, the bottle stopper can easily be inserted into or removed from a mouth of a container or can still loosely seal the container.

Figure 3:
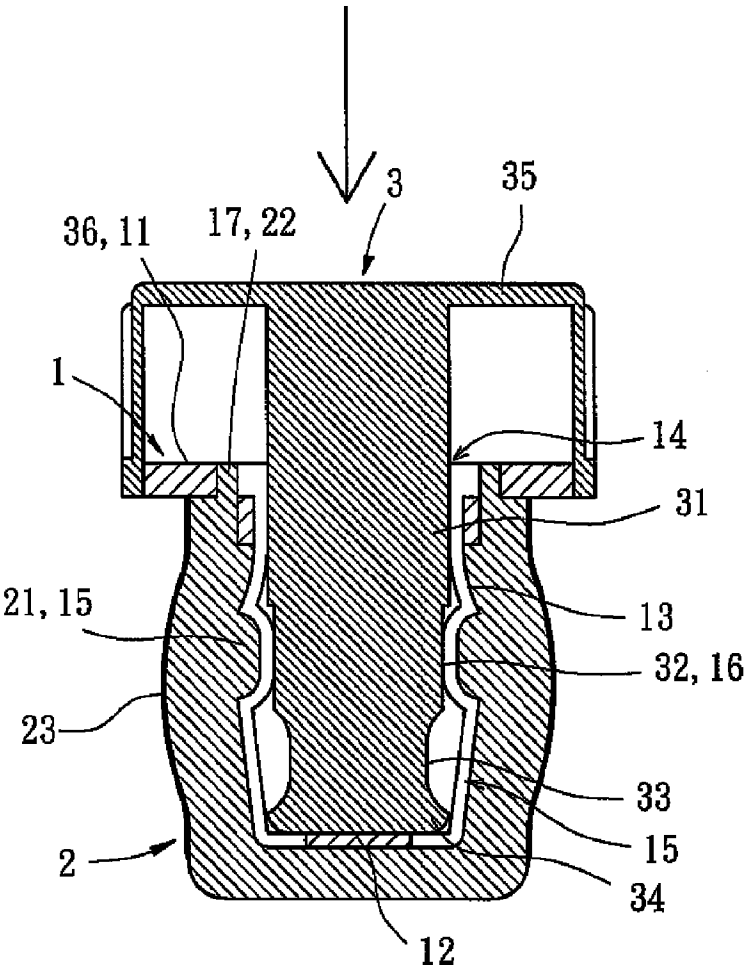
FIG. 3 is a sectional view illustrating use of the expansible bottle stopper of the first embodiment according to the present invention by expansion.

With reference to FIG. 3, when it is desired to tightly seal the mouth of the container with the bottle stopper, the movable member 3 is axially moved relative to the body 1 to proceed with a first-stage axial displacement. In this embodiment, the movable member 3 is pressed downward (as viewed from the drawing sheet) relative to the body 1. Thus, the abutting portion 32 of the shank 31 abuts against the abutting portions 16 of the connecting plates 13 of the body 1 to radially expand the connecting plates 13 of the body 1 and, hence, the resilient member 2. The mouth of the container is, thus, tightly sealed.

When it is desired to remove the bottle stopper from the mouth of the container, the movable member 3 is moved axially relative to the body 1 to proceed with a second-stage axial displacement. In this embodiment, the movable member 3 is pulled upward (as viewed from the drawing sheet) relative to the body 1. Thus, the coupling portion 33 of the movable member 3 is engaged with the abutting portion 16 of the connecting plates 13 of the body 1 (see FIG. 2). The resilient member 2 shrinks radially under action of its own resiliency to restore the smaller diameter state of the resilient member 2. In this state, the bottle stopper can easily be removed from the mouth of the container or loosely seal the container.

Figure 4:
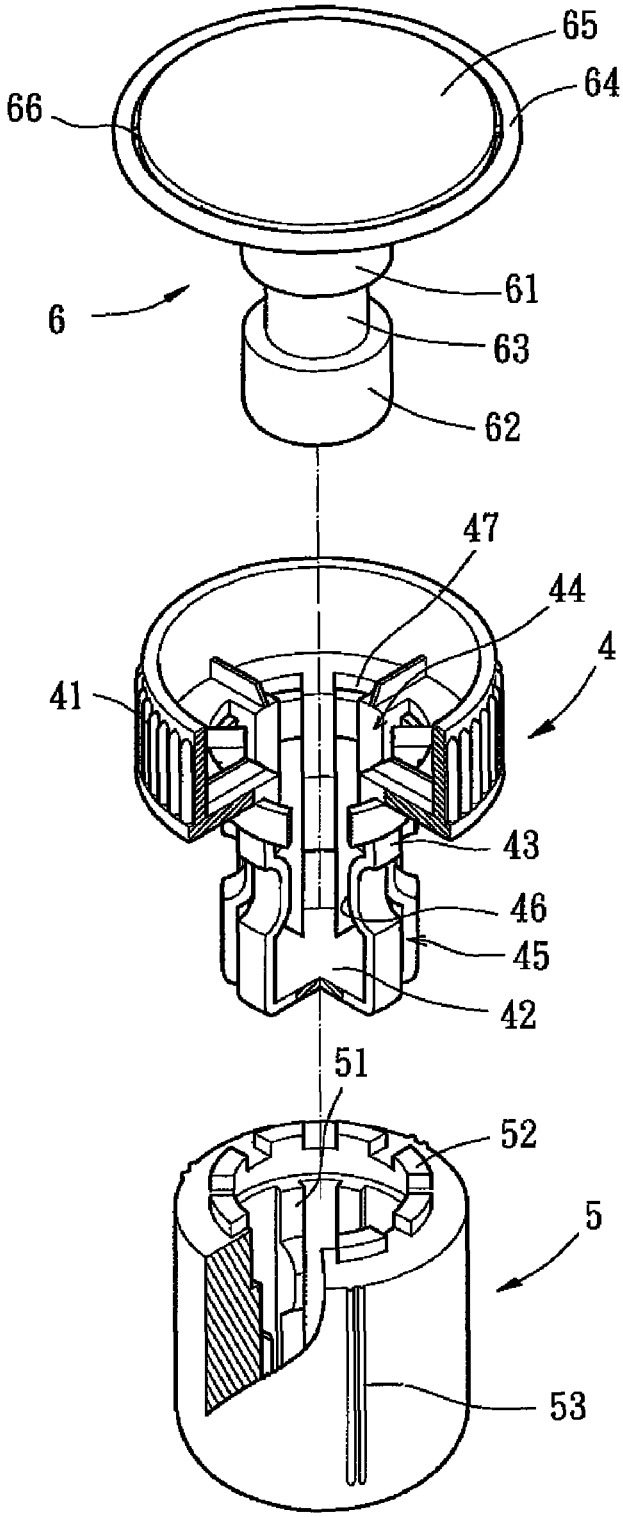
FIG. 4 is an exploded perspective view of an expansible bottle stopper of a second embodiment according to the present invention.

Referring to FIG. 4, an expansible bottle stopper of a second embodiment according to the present invention includes a body 4, a resilient member 5, and a movable member 6. The body 4 can be formed by injection molding of inert material such as plastics. The body 4 includes an annular wall 41 in the form of a cap. Alternatively, the annular wall 41 can be coupled with a cap made of metal, ceramic, china, wood, or glass materials. The annular wall 41 includes a circular hole 44 defined therein. A plurality of annularly spaced connecting plates 43 axially extend from and is connected to the annular wall 41, with a gap 45 formed between a pair of adjacent connecting plates 43. Each connecting plate 43 includes an abutting portion 46 extending radially inward. In this embodiment, each abutting portion 46 and the plurality of annularly spaced connecting plates 43 further define the circular hole 44. Distal ends of the connecting plates 43 are connected together by a bottom disc 42 to provide improved strength for the connecting plates 43.

The resilient member 5 can be made of rubber or combined rubber/plastic materials by foaming to form an elastomer with appropriate compressibility. In this embodiment, the resilient member 5 is cylindrical and engaged around the connecting plates 43 of the body 4. Alternatively, the resilient member 5 and the body 4 are integrally formed, with ribs 51 on the resilient member 5 fitted in the gaps 45 of the body 4, and with protrusions 52 on top of the resilient member 5 engaged in preserved slots 47 in the annular wall 41. Thus, the resilient member 5 and the body 4 can be firmly engaged without the risk of falling. The resilient member 5 includes a plurality of air guiding channels 53 on an outer periphery thereof, allowing gas in a container to be exhausted when the resilient member 5 is mounted in a mouth of the container.

The movable member 6 can be made by injection molding of inert material such as plastics. The movable member 6 includes a disc 65 of a larger area and a shank 61 extending from a side of the disc 65. The disc 65 may be in the form of a cap. Alternatively, the disc 65 can be coupled with a cap made of metal, ceramic, china, wood, or glass materials. The shank 61 can be inserted into the circular hole 44 of the body 4. The shank 61 includes an abutting portion 62 that abuts against the abutting portion 46 of the body 4 such that the connecting plates 43 of the body 4 can push the resilient member 5 to expand radially. The shank 61 further includes a reduced coupling portion 63. When the shank 61 of the movable member 6 moves axially relative to the body 4, the coupling portion 63 engages with the abutting portion 46 to cause radial shrinkage of the resilient member 5. The radial shrinkage extent of the resilient member 5 can be fixed by determining the difference between the diameter of the coupling portion 63 and the shank 61, with the resilient member 5 having a predetermined diameter according to designs. Furthermore, in this embodiment, the disc 65 of the movable member 6 includes a ring 64 surrounding the disc 65 and connected to the outer periphery of the disc 65 by a fragile connecting portion 66. When the shank 61 of the movable member 6 is moved axially downward relative to the body 4, the connecting portion 66 breaks to cause disconnection of the ring 64 from the disc 65, with the movable member 6 sinking in the annular wall 41 of the body 4. Since the abutting portion 46 of the body 4 is engaged with the coupling portion 63 of the shank 61, the movable member 6 cannot move back to its initial position.

Figure 5:
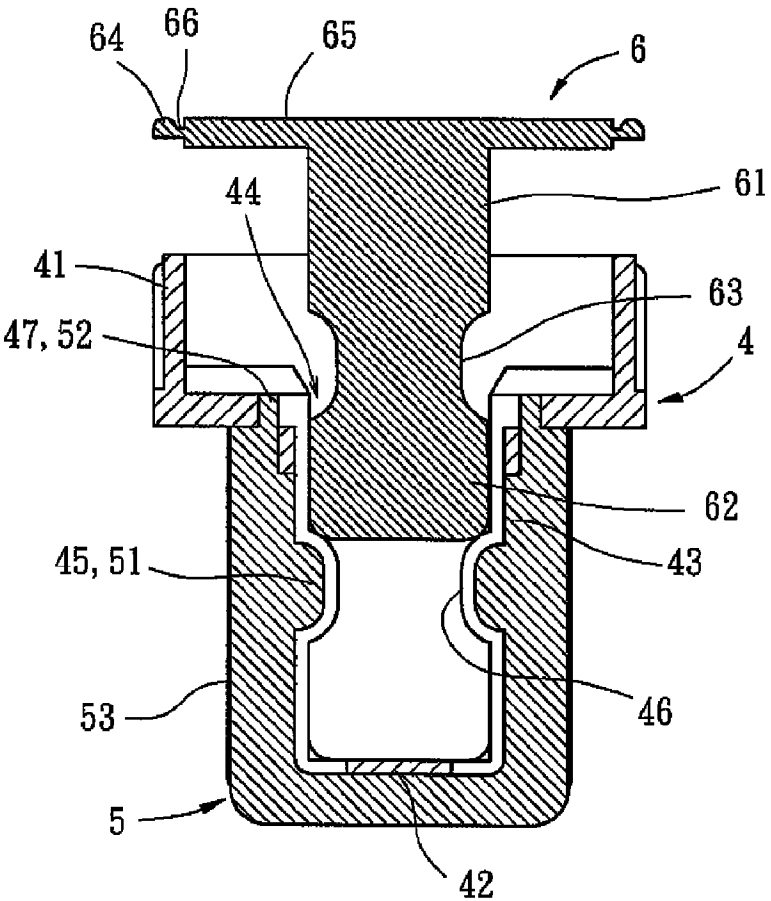
FIG. 5 is a sectional view of the expansible bottle stopper of the second embodiment according to the present invention after assembly.

FIG. 5 shows the bottle stopper of the second embodiment after assembly. The movable member 6 is in a free state allowing it to be inserted into or removed from the body 4.

Figure 6:
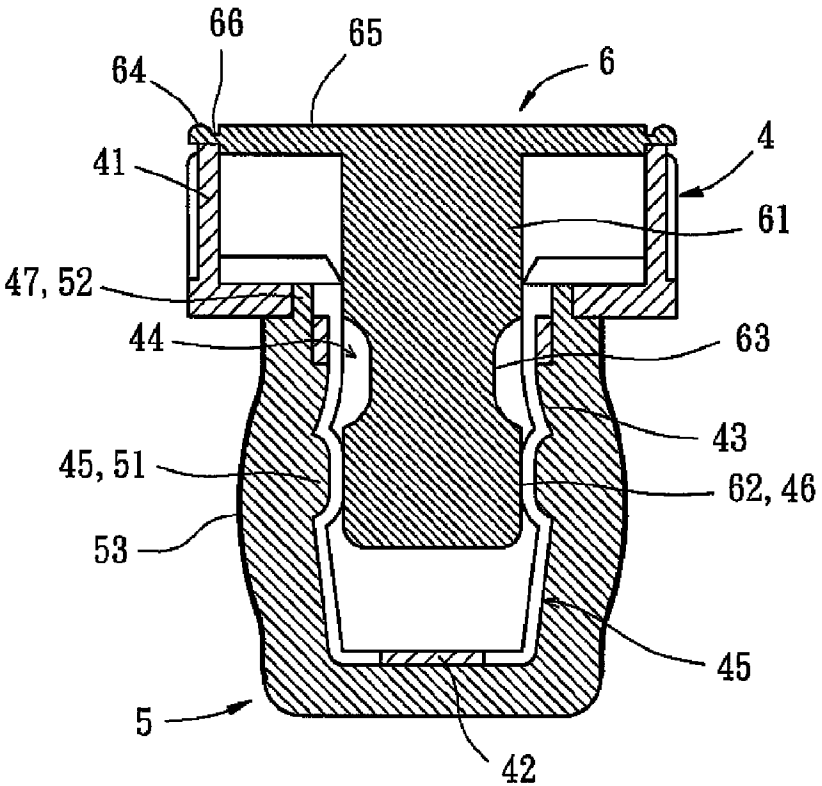
FIG. 6 is a sectional view illustrating use of the expansible bottle stopper of the second embodiment according to the present invention by expansion.

With reference to FIG. 6, when it is desired to tightly seal the mouth of the container with the bottle stopper, the movable member 6 is axially moved relative to the body 4 to proceed with a first-stage axial displacement. In this embodiment, the movable member 6 is pressed downward (as viewed from the drawing sheet) relative to the body 4 to make the ring 64 and the disc 65 in contact with the top of the annular wall 41 of the body 4. At this time, the abutting portion 62 of the shank 61 abuts against the abutting portions 46 of the connecting plates 43 of the body 4. Thus, the connecting plates 43 of the body 4 expand radially to cause radial expansion of the resilient member 5 to thereby tightly seal the mouth of the container.

Figure 7:
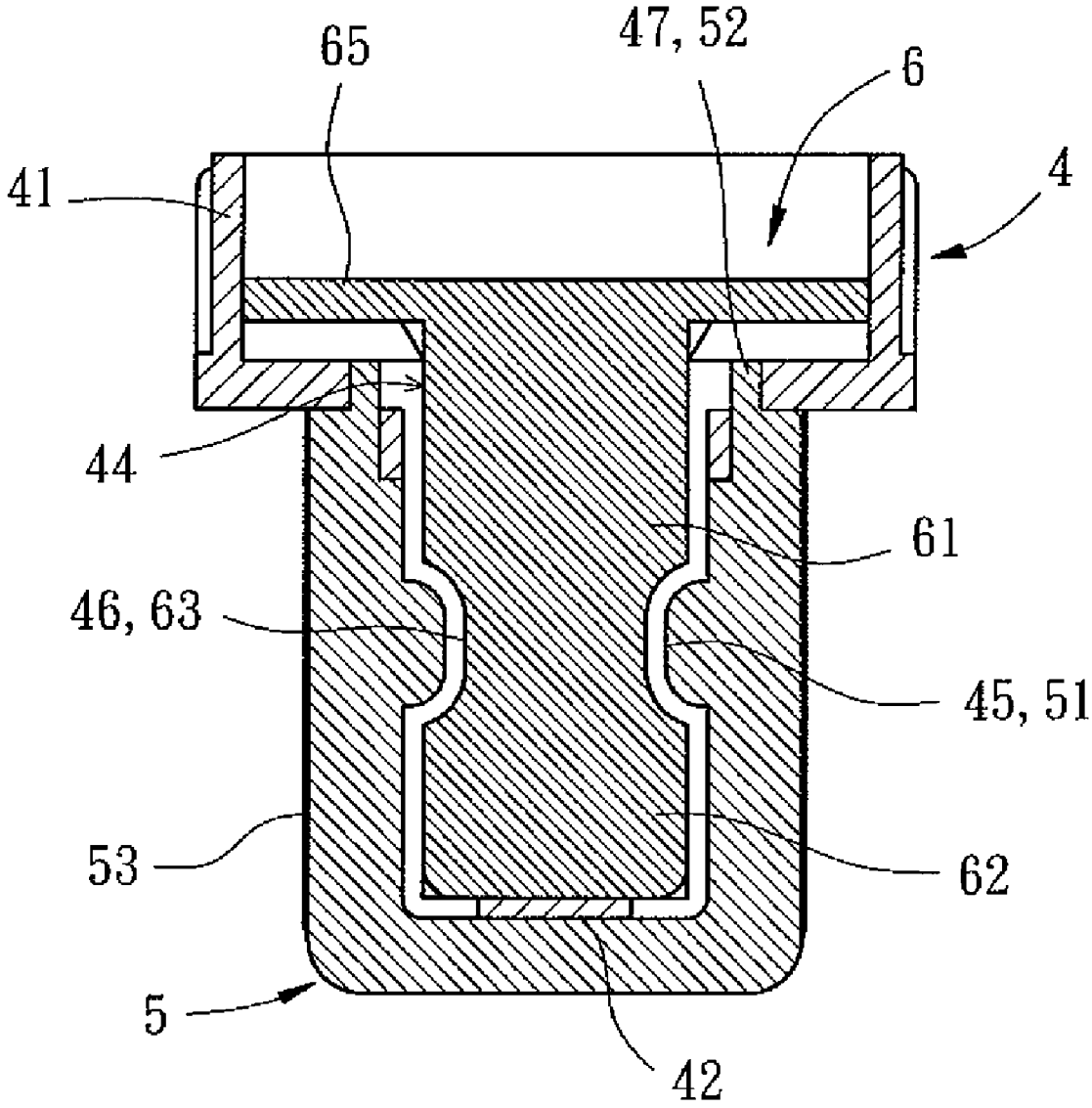
FIG. 7 is a sectional view illustrating the bottle stopper of the second embodiment in a state allowing opening.

With reference to FIG. 7, when it is desired to remove the bottle stopper from the mouth of the container, the movable member 6 is pressed downward relative to the body 4 to proceed with a second-stage axial displacement. At this time, the connecting portion 66 breaks and causes disconnection of the ring 64 from the disc 65, with the disc 65 sinking in the annular wall 41 of the body 4. Furthermore, the coupling portion 63 of the shank 61 engages with the abutting portions 46 of the connecting plates 43 of the body 4. Thus, besides destruction of the ring 64, the movable member 6 cannot return its initial position due to engagement between the coupling portion 63 of the movable member 6 and the abutting portions 46 of the body 4. This provides an anti-forgery effect. When the coupling portion 63 of the movable member 6 engages with the abutting portions 46 of the body 4, the resilient member 5 shrinks to its smaller diameter state under action of its resiliency. In this state, the bottle stopper can be removed from the mouth of the container. Furthermore, the diameter of the resilient member 5 after shrinkage can be designed according to the diameter of the coupling portion 63 of the shank 61 or the protruded extent of the abutting portions 46 of the connecting plates 43 of the body 4 such that the diameter of the resilient member 5 is slightly larger than the inner diameter of the mouth of the container, allowing resealing of the mouth of the container by the bottle stopper.

According to the foregoing, the bottle stopper of the present invention can radially expand by the first-stage axial displacement of the movable member relative to the body, and the diameter of the bottle stopper is larger than the inner diameter of the mouth of the container so that the resilient member can be fixedly and tightly pressed against the inner wall of the mouth of the container, obtaining enhanced sealing effect for the contents in the container. Furthermore, the resilient member shrinks radially by the second-stage axial displacement of the movable member relative to the body. Thus, the diameter of the resilient member can be set to a predetermined size to allow easy insertion or removal of the bottle stopper into or from the mouth of the container or to allow loosely sealing of the container by the bottle stopper.

In the bottle stopper of the present invention, the connecting plates of the body are annularly arranged in a radial manner so that the connecting plates can expand radially to provide enhanced sealing effect between the bottle stopper and the container while having a simpler structure to cut costs.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. An expansible bottle stopper comprising:

a body including a top disc and a plurality of connecting plates, with the plurality of connecting plates being axially extending and annularly spaced and connected to the top disc, with a gap being defined between adjacent pairs of connecting plates, with each said connecting plate including an abutting portion protruding in a radial manner, with a circular hole defined through the top disc and defined by the plurality of connecting plates, with the body further including a bottom disc, and with each said connecting plate having an end connected to the bottom disc;

a compressible resilient member coupled with outer sides of the connecting plates of the body; and a movable member including a head and a shank extending from a side of the head, with the shank including an abutting portion for abutting against the abutting portions of the body to radially expand the resilient member, with the shank including a reduced coupling portion, and with the coupling portion being engaged with the abutting portion of the body to cause radial shrinkage of the resilient member when the shank of the movable member is moved axially relative to the body.

2. The bottle stopper as claimed in claim 1, with the resilient member including at least one air guiding channel in an outer periphery thereof.

3. The bottle stopper as claimed in claim 1, with the head of the movable member being in the form of a cap.

4. The bottle stopper as claimed in claim 1, with the head of the movable member being adapted for coupling with a cap made of metal, ceramic, china, wood or glass materials.

5. The bottle stopper as claimed in claim 1, with the head of the movable member including a stop to be abutted against by the top disc of the body.

6. The bottle stopper as claimed in claim 1, with the coupling portion of the movable member including a disengagement preventing portion below the shank to prevent the movable member from disengaging from the body.

7. The bottle stopper as claimed in claim 6, with the disengagement preventing portion having a diameter larger than that of the abutting portion.

8. A bottle stopper comprising:

a body including an annular wall and a plurality of connecting plates, with the plurality of connecting plates being axially extending and annularly spaced and connected to the annular wall, with a gap being defined between adjacent pairs of connecting plates, with each said connecting plate including an abutting portion protruding in a radial manner, with a circular hole defined through the annular wall and defined by the plurality of connecting plates, with the body further including a bottom disc, and with each said connecting plate having an end connected to the bottom disc;

a compressible resilient member coupled with outer sides of the connecting plates of the body; and a movable member including a disc of a larger area and a shank extending from a side of the disc, with the shank including an abutting portion for abutting against the abutting portions of the body to radially expand the resilient member, with the shank including a reduced coupling portion, and with the coupling portion being engaged with the abutting portion of the body to cause radial shrinkage of the resilient member when the shank of the movable member is moved axially relative to the body.

9. The bottle stopper as claimed in claim 8, with the annular portion of the body being in the form of a cap.

10. The bottle stopper as claimed in claim 8, with the resilient member including at least one air guiding channel in an outer periphery thereof.

11. The bottle stopper as claimed in claim 8, with the disc of the movable member being adapted for coupling with a cap made of metal, ceramic, china, wood or glass materials.

12. The bottle stopper as claimed in claim 8, with the disc of the movable member further including a ring surrounding the outer periphery of the disc and a fragile connecting portion interconnected between the ring and the outer periphery of the disc.

13. The bottle stopper as claimed in claim 12, with the disc of the movable member sinking in the annular wall when the movable member is pressed axially downward relative to the body.

14. The bottle stopper as claimed in claim 8, with a diameter of the resilient member in a state in which the coupling portion thereof is engaged with the abutting portions of the body being larger than that of the resilient member before expansion.

* * * * *